US006424299B1

(12) United States Patent
Cha et al.

(10) Patent No.: US 6,424,299 B1
(45) Date of Patent: Jul. 23, 2002

(54) DUAL HYBRID-FED PATCH ELEMENT FOR DUAL BAND CIRCULAR POLARIZATION RADIATION

(75) Inventors: Alan Cha, Glendale; Arun Bhattacharyya, El Segundo, both of CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/925,773

(22) Filed: Aug. 9, 2001

(51) Int. Cl.[7] ..... H01Q 1/38
(52) U.S. Cl. ..... 343/700 MS; 343/846
(58) Field of Search ..... 343/700 MS, 846, 343/848, 850, 860; H01Q 1/38

(56) References Cited

U.S. PATENT DOCUMENTS 4,903,033 A * 2/1990 Tsao et al. ..... 343/700 MS
5,043,738 A * 8/1991 Shapiro et al. ..... 343/700 MS
5,124,713 A * 6/1992 Mayes et al. ..... 343/700 MS
5,861,848 A 1/1999 Iwasaki ..... 343/700 MS
5,969,681 A 10/1999 O'Neill, Jr. ..... 343/700 MS
6,018,319 A 1/2000 Lindmark ..... 343/700 MS
6,124,829 A 9/2000 Iwasaki ..... 343/700 MS

* cited by examiner

*Primary Examiner*—Hoanganh Le
(74) *Attorney, Agent, or Firm*—Terje Gudmestad

(57) ABSTRACT

A dual-band patch antenna element (10) for circular or linear polarization. The patch element (10) is excited by two different hybrids (22, 24), designed for transmit and receive bands respectively. Each hybrid (22, 24) electromagnetically couples a pair of orthogonal ground plane slots (26, 28, 30, 32) that excite the patch antenna (10). The hybrid (22) and slot (26, 28) dimensions for the transmit band are different from the hybrid (24) and slot (30, 32) dimensions for the receive band. Isolation can be improved by connecting shunt stubs (34, 36) to the hybrids (22, 24).

9 Claims, 3 Drawing Sheets

DUAL HYBRID-FED PATCH ELEMENT FOR DUAL BAND CIRCULAR POLARIZATION RADIATION

TECHNICAL FIELD

The present invention relates generally to antenna systems, and more particularly to a dual-band patch antenna element for circular polarization radiation.

BACKGROUND ART

A patch antenna is typically used to provide a quasi-hemispherical radiation pattern and linearly or circularly polarized waveforms that are necessary for satellite communications systems. However, the bandwidth of these antennas is small. Therefore, certain applications that have relatively large separation between transmit and receive frequency bands typically exceed the bandwidth provided by a conventional patch antenna. A conventional patch antenna cannot cover more than a 5% bandwidth due to its inherent narrow bandwidth characteristics.

Additionally, the bandwidth of a patch antenna may also be limited by power transfer considerations. Often the power transfer between the transmit and receive bands has losses due to reflections, which are a result of imperfect impedance matching. This reflected power loss impairs the operation of the satellite system.

There is a need for a method and system that is capable of providing a circularly polarized waveform over two bands that are separated by more than 10% of the mid-frequency between the transmit and receive bands.

SUMMARY OF THE INVENTION

It is an object of the present invention to generate circularly polarized waves at two frequency bands. It is another object of the present invention to generate circularly polarized waves at two bands separated by more than 10% of the mid-frequency.

A further object of the present invention is to improve isolation between transmit and receive bands over conventional single hybrid-fed elements. It is still a further object of the present invention to excite a patch element using two different hybrids for transmit and receive bands respectively.

The present invention is a dual-band patch antenna element for circular polarization. The patch element is excited by two different hybrids, designed for transmit and receive bands respectively. Each hybrid electromagnetically couples a pair of orthogonal ground plane slots that excite the patch antenna. The hybrid and slot dimensions for the transmit band are different from the hybrid and slot dimensions for the receive band. Isolation can be improved by connecting shunt stubs to the hybrids.

These and other features of the present invention will be better understood with regard to the following description, appended claims, and accompanying drawings.

BEST MODE FOR CARRYING OUT THE INVENTION

Figure 1:
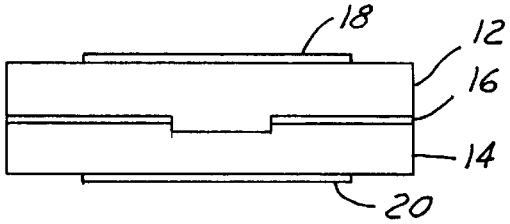
FIG. 1 is a side view of a patch antenna according to the present invention.

Referring to FIG. 1 there is shown a side view of a patch antenna element 10 of the present invention. A ground plane 16 separates a patch dielectric substrate 12 from a feed dielectric substrate 14. The ground plane 16 is typically a thin metallic conductor. A first conducting patch layer 18 is substantially parallel to the ground plane 16 and they are separated by the patch substrate 12. It should be noted that while a square patch element for the conducting layer 18 shown in FIGS. 1 and 2, the present invention is equally applicable to a circular patch element.

Figure 2:
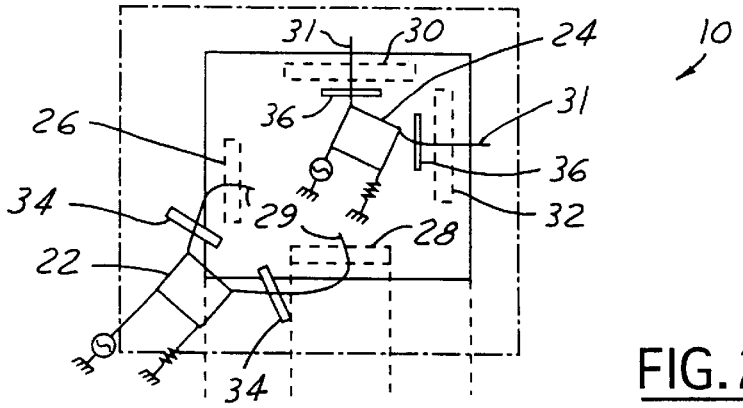
FIG. 2 is a top view of the patch antenna according to the present invention.

Referring now to FIG. 2, the feed substrate has first and second hybrids 22 and 24. Typically, the hybrids are etched into the feed substrate 14. The first hybrid 22 is designed for a transmit band, while the second hybrid 24 is designed for a receive band. The feed substrate 14 typically has a high dielectric constant in order to make the hybrid elements 22 and 24 as compact as possible.

Four slots 26, 28, 30 and 32 are cut into the ground plane 16. The four slots 26, 28, 30 and 32 are paired and each slot in a pair has identical dimensions. One pair 26, 28 is designated for the transmit band and the other pair 30, 32 is designated for the receive band. The ground plane slots couple the hybrids with the radiating patch 18. Each hybrid 22 and 24 is coupled with a respective pair of slots. In the present example, the hybrid 22 is coupled with the slot pair containing slots 26, 28 and the hybrid 24 is coupled with the slot pair containing slots 30 and 32.

Because the slots in a pair have identical dimensions, circularly polarized radiation is achieved. However, the transmit slot pair 26, 28 has slot dimensions that are different than the dimensions in the receive slot pair 30, 32. The slot dimensions are designed to have separate resonances in the transmit and receive bands. For example, the transmit band may be 1.93 GHz, while the receive band is 2.15 GHz. The slot dimensions of each pair will be optimized for their respective band.

Figure 3:
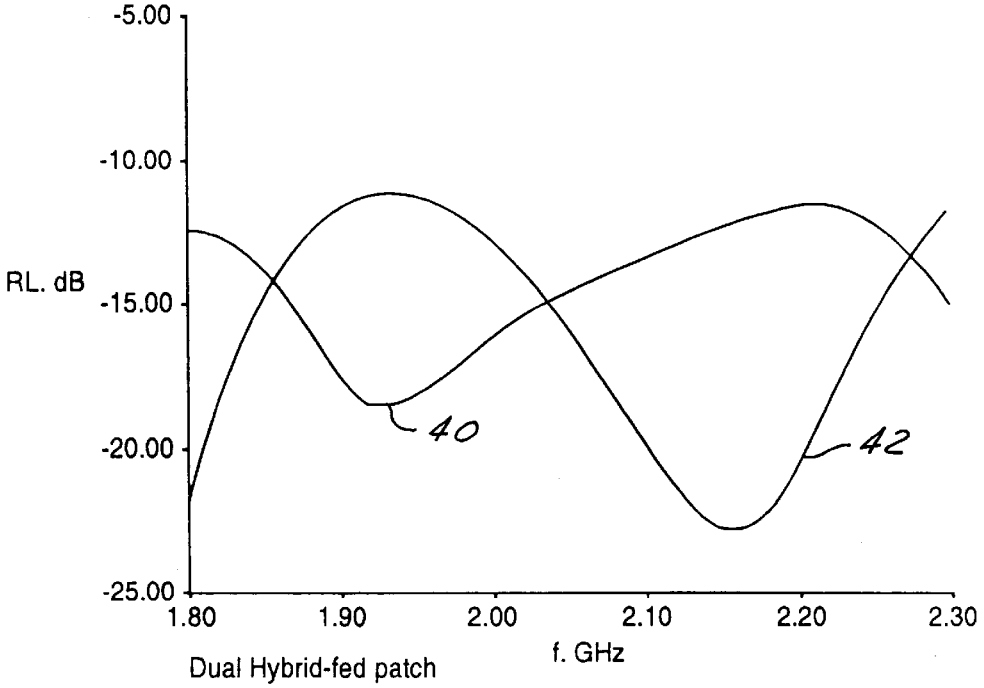
FIG. 3 is a graph of the return loss versus the frequency of the patch antenna element of the present invention.

FIG. 3 is a graph of the return loss behavior of the dual hybrid-fed patch element in an infinite array environment of the present invention. In the example shown in FIG. 3, the cell dimensions are 7 cm×7 cm overall with a patch dimension of 5.65 cm×5.65 cm. The slot dimensions are 2.94 cm×0.2 cm for a 1.93 GHz band and 2.82 cm×0.2 cm for the 2.15 GHz band. The patch substrate is 0.5 cm high and the feed substrate is 0.159 cm thick. FIG. 3 shows that the return loss is better than −18 dB for both the transmit band 40 and the receive band 42. This return loss is acceptable for many applications. However, the isolation between the bands could be improved.

FIG. 3 shows the return loss at the transmit band hybrid port is about −10 dB at the receive frequency band of 2.15 GHz while the return loss at the receive band hybrid port is about −10 dB at the transmit frequency band of 1.93 GHz. This shows poor isolation between the bands.

Referring again to FIG. 2, it is possible to enhance the isolation of the patch antenna element 10 of the present invention by connecting open circuit stubs 34 and 36 in parallel at output ports 29 and 31 of the hybrids 22 and 24 respectively. The open circuit stubs can be printed on the feed substrate 14.

Figure 4:
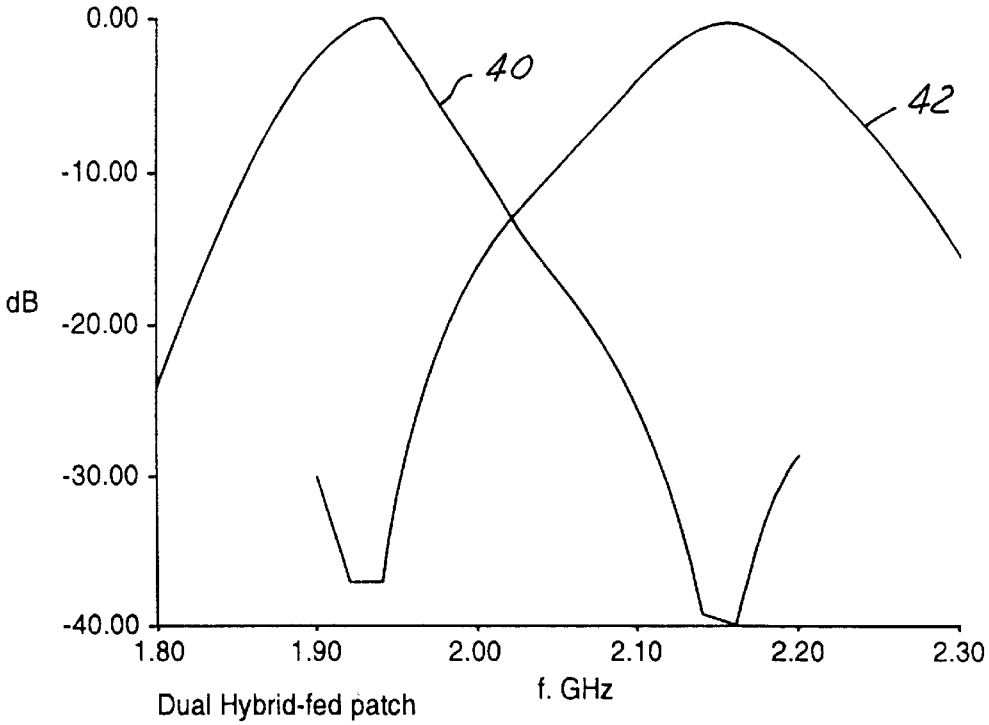
FIG. 4 is a graph of the return loss versus frequency for an embodiment of the patch antenna having shunt stubs.

FIG. 4 shows the improved isolation between the transmit and receive bands 40, 42 when appropriate stubs are added at the output ports of the hybrids. With the addition of open circuit stubs, the isolation between bands is improved to better than −35 dB. In the example shown in FIG. 4, the same polarization is used in the transmit and receive bands. If opposite polarizations are used in the transmit and receive bands, the isolation would be better than −50 dB. In many applications, an isolation of −50 dB would eliminate the need for an external filter.

Figure 5:
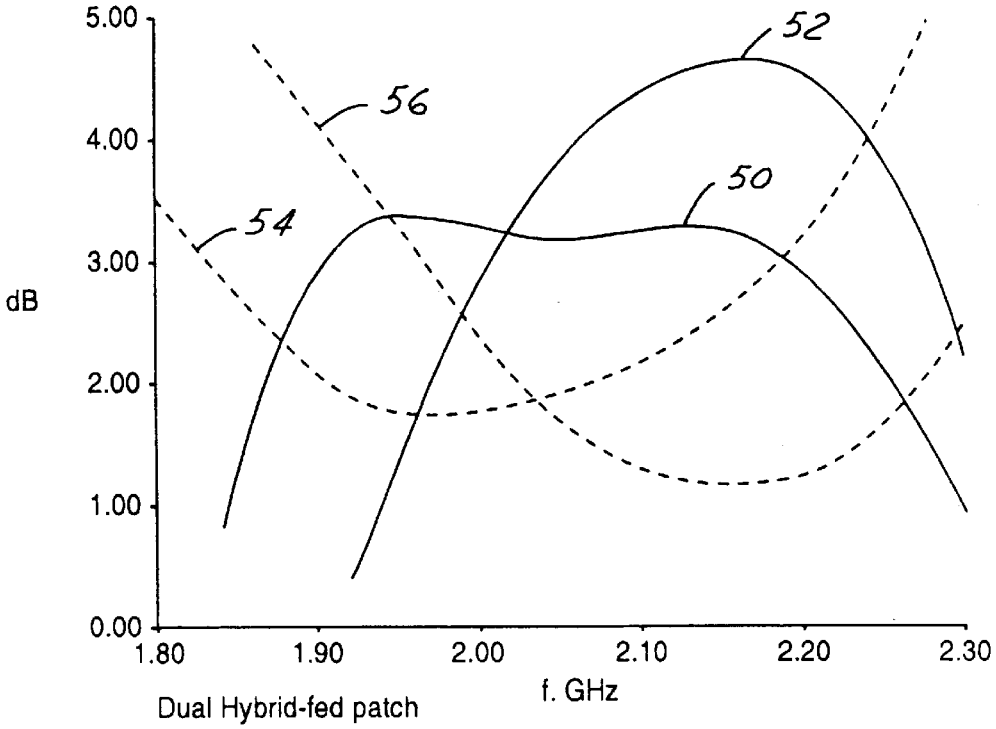
FIG. 5 is a graph of the gain and axial ratio performance of the patch antenna element of the present invention.

FIG. 5 is a graph of the gain and axial ratio characteristics of the antenna element in an array environment for boresight radiation. The gain 50 at the transmit band is about 3.5 dBi. The gain 52 at the receive band is about 4.5 dBi. The difference of about 1 dB gain is partly due to the difference in the electrical size of the element and partly due to the hybrid loss. The axial ratio 54 is about 2 dB for the transmit band and the axial ratio 56 of the receive band is about 1 dB.

According to the present invention, the isolation between the transmit and receive bands is improved through the use of only passive devices in the antenna element. Passive components typically have minimal radio frequency (RF) losses. The different slot dimensions and printed open stubs allow the present invention to avoid using active components which, due to the inherent high losses, are not desirable in many applications, and space applications in particular.

It is noted that the present invention may be used in a wide variety of different implementations encompassing many alternatives, modifications, and variations, which are apparent to those with ordinary skill in the art. For example, the present invention can be applied to a dual-band, dual-circular polarization application.

Figure 6:
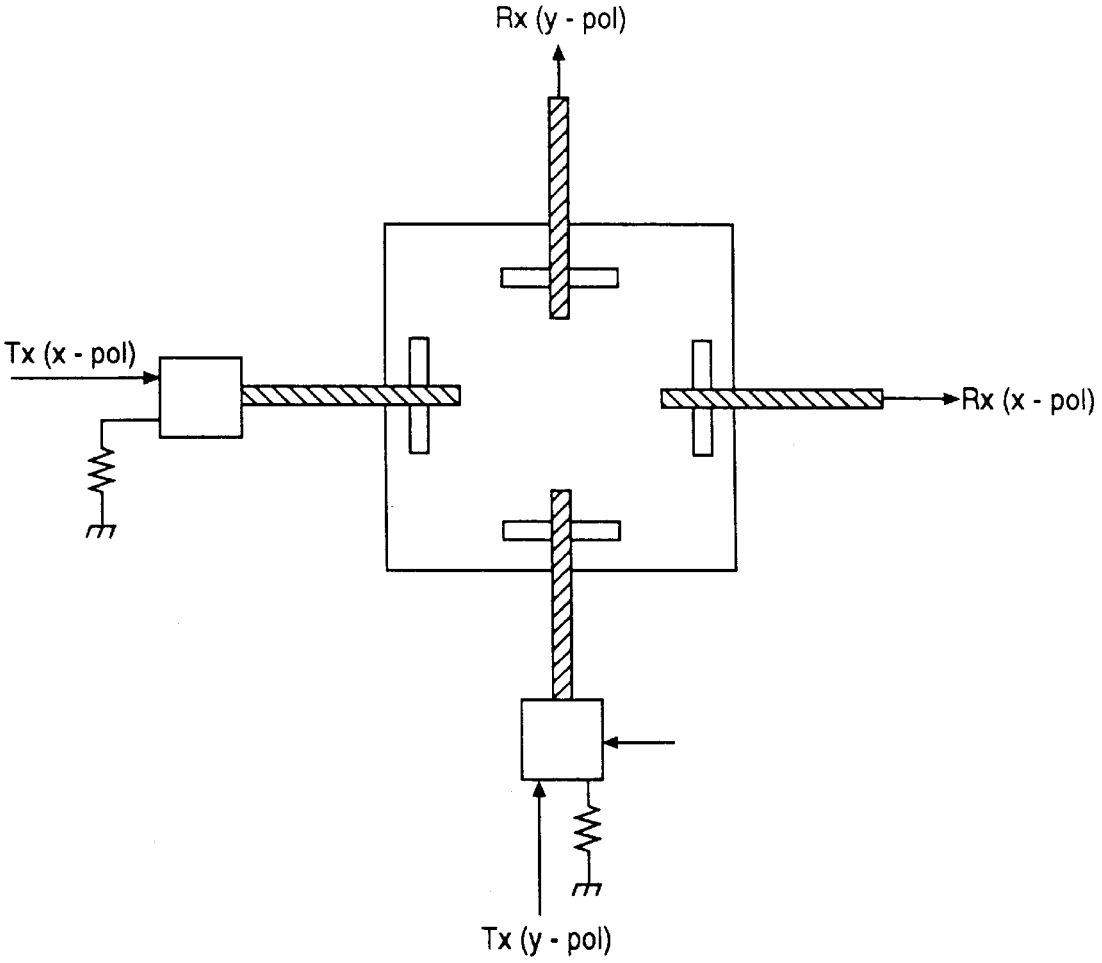
FIG. 6 is a top view of a patch antenna having feed networks for dual linear polarization.

Also, for narrow transmit and receive bands and for circular polarization in each band, the hybrids can be replaced with 3 dB power dividers. 90 degree phase differences would be realized by line lengths. Modifications may be made to the feed structure so that the feed structure can be used for dual band, dual linear polarization applications. For example, the hybrids are replaced with feed networks 60 as shown in FIG. 6 along with isolators 62 to provide isolation between x and y polarized signals in the transmit band. Accordingly, the present invention is intended to embrace all such alternatives, modifications and variations that fall within the spirit and scope of the appended claims.

What is claimed is:

1. A patch antenna element comprising:

a feed substrate;

a patch substrate;

a ground plane located between said feed substrate and said patch substrate, said ground plane having a first pair of slots, each slot in said first pair having equal dimensions and a second pair of slots, each slot in said second pair having equal dimensions;

a first hybrid in said feed substrate and having an output port connected at each slot in said first pair of slots;

a second hybrid in said feed substrate and having an output port connected at each slot in said second pair of slots; and wherein said first pair of slots have dimensions that are different from said dimensions of said slots in said second pair for separate resonances in a transmit band and a receive band.

2. The patch antenna element as claimed in claim 1 further comprising open circuit stubs at each output port of said first and second hybrids.

3. The patch antenna element as claimed in claim 2 wherein said open circuit stubs are printed on said feed substrate.

4. The patch antenna element as claimed in claim 1 wherein said first pair of slots is dedicated to said transmit frequency band and said second pair of slots is dedicated to said receive frequency band.

5. The patch antenna element as claimed in claim 4 wherein said transmit and receive bands are separated by more than 10% of their mid-frequency.

6. The patch antenna element as claimed in claim 1 wherein said feed substrate has a dielectric constant on the order of 10.

7. The patch antenna element as claimed in claim 1 wherein said first and second hybrids further comprise 3 dB power dividers.

8. The patch antenna element as claimed in claim 1 wherein said first and second hybrids further comprise feed networks for dual band, dual linear polarization.

9. The patch antenna element as claimed in claim 1 wherein said first and second hybrids are used for dual band, dual circular polarization.

* * * * *